United States Patent [19]

Hurwitz

[11] 4,123,818

[45] Nov. 7, 1978

[54] CARPET AND FLOOR WASHING ACCESSORY FOR WET PICK-UP-VACUUM CLEANERS

[76] Inventor: Mathew Hurwitz, 63 Oakland Ave., Auburndale, Mass. 02166

[21] Appl. No.: 730,314

[22] Filed: Oct. 7, 1976

[51] Int. Cl.[2] ..... A47L 5/34

[52] U.S. Cl. ..... 15/321; 15/328; 15/339

[58] Field of Search ..... 15/320, 321, 353, 339, 15/328; 137/557

[56] References Cited

U.S. PATENT DOCUMENTS

| | | | |
|---|---|---|---|
| 2,531,370 | 11/1950 | Thompson | 15/321 |
| 2,978,719 | 4/1961 | Arones | 15/320 X |
| 3,431,582 | 3/1969 | Grave | 15/353 X |
| 3,507,309 | 4/1970 | Johnson | 137/557 X |
| 3,720,977 | 3/1973 | Brycki | 15/321 |
| 3,919,729 | 11/1975 | Cannan | 15/321 X |
| 3,942,217 | 3/1976 | Bates | 15/353 X |
| 3,975,790 | 8/1976 | Patterson | 15/339 |

*Primary Examiner*—Christopher K. Moore

*Attorney, Agent, or Firm*—Arnstein, Gluck, Weitzenfeld & Minow

[57] ABSTRACT

A low-cost accessory for a conventional tank-type wet-pickup vacuum cleaner which converts such a vacuum cleaner into a self-contained hot water extraction type of carpet shampooer and floor cleaner suitable for use by homeowners. The accessory includes a reservoir which attaches compactly to the vacuum cleaner. The reservoir is intended to be filled with a cleaning solution of hot water and detergent and includes means for feeding the cleaning solution to a spray nozzle located behind the vacuum pickup nozzle. A hand-controlled valve permits the operator to dispense cleaning solution and to interrupt the flow of solution while vacuuming the wetted floor or carpet. In a preferred embodiment the reservoir is a pressurizable toroidal shaped tank which fits around the vacuum cleaner. The reservoir is pressurized by an integral manual air pump. An indicating pressure relief valve provides a measure of air pressure and prevents over pressurization of the reservoir. The air pressure forces cleaning solution to the spray nozzle. In a modified embodiment, a motor driven pump assembly is employed to deliver detergent fluid to the point of use thus, eliminating the need for pressurization of the reservoir.

7 Claims, 11 Drawing Figures

CARPET AND FLOOR WASHING ACCESSORY FOR WET PICK-UP-VACUUM CLEANERS

BACKGROUND OF THE INVENTION

This invention relates to an apparatus for converting an ordinary wet pick-up vacuum cleaner into an efficient hot water extraction type of cleaning system for carpets and hard floors.

The most common modern prior art systems utilize a permanently combined reservoir and canister type wet pick-up vacuum cleaner and incorporate a high pressure motor driven pump to force a hot water/detergent solution from the storage reservoir housed adjacent the vacuum tank, through a hose and a control valve, to a series of nozzles which discharge the washing solution as a spray onto the floor or carpet. The spent solution and dirt then are drawn into the vacuum cleaner through a pickup nozzle and suction hose connected to the vacuum tank.

Other earlier prior art systems are built upon the concept of an upright vacuum apparatus and incorporate a small reservoir in the handle which feeds a cleaning solution by gravity or by a spring-loaded bellows or bladder or the like, to a series of rotary brushes which work the detergent into the carpet or floor. A few of such devices have built-in vacuum means for picking up the spent solution and dirt but the majority do not. These types of apparatus use a high-foaming detergent which is allowed to dry on the carpet and then later is dry vacuumed to complete the cleaning process.

In general, the systems of the first type are effective for use on carpets and floors while those of the second type are rather inefficient since they remove very little, if any, of the dirt from carpets. Accordingly, these devices are used primarily only on hard floors.

Generally, the prior systems of the first type are ruggedly built, are relatively expensive to manufacture and are intended for sale to professional users or for rental service to businesses and homeowners rather than for mass marketing to individual homeowners.

Accordingly, it is an object of the present invention to provide an accessory compatible with many conventional wet-pick-up vacuum cleaners, which accessory converts the vacuum cleaner into a modern hot-water-extraction system for cleaning floors and shampooing carpets.

Another object of this invention is to provide an accessory of the foregoing type which can be manufactured economically for sale at a low price to meet the mass market.

A further object of this invention is the provision of an accessory of the foregoing type which is simple to operate and includes no complicated or costly components which might require maintenance, adjustment, or service in the field.

Still another object is an accessory of the foregoing type which may be removed from the vacuum cleaner and stored, when not in use, to permit the separate use of the vacuum cleaner alone for conventional cleaning purposes.

Still a further object of this invention is the provision of an accessory of the foregoing type which may be sold separately as an adjunct to existing vacuum cleaners or which may be sold as a combined package with the vacuum cleaner included.

Other and further objects and advantages will become apparent from the following description when considered in connection with the accompanying drawings.

BRIEF DESCRIPTION OF A PREFERRED EMBODIMENT

Figure 1:
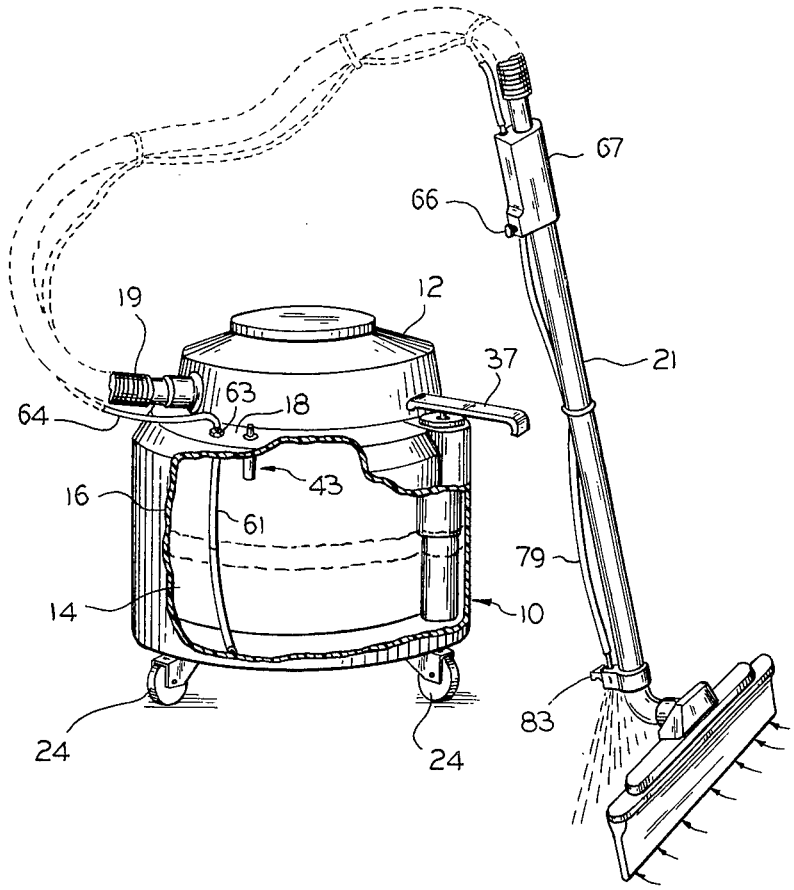
FIG. 1 is a perspective view of the apparatus, with a portion broken away, showing the complete assembly of the accessory together with a wet- pick-up vacuum cleaner, as the system would appear when filled and ready for use.

Referring to the drawings, the apparatus of my invention comprises a closed pressure vessel or reservoir 10, preferably in the form of a toroid or double walled cylinder providing a central well 11 in which is nested a conventional wet pick up canister type vacuum cleaner 12, hereinafter to be described.

The reservoir 10 functioning as a supply tank for the hot cleaning solution includes concentric inner and outer walls, 14 and 16, respectively, an annular base 17 and an annular top wall 18. The reservoir 10, preferably is formed of a suitable plastic, such as polypropylene or of any other suitable material which has adequate strength at elevated temperatures, good water resistance and high fatigue strength. The reservoir 10 may be formed in two sections by injection molding, with the sections welded together, preferably by ultrasonic means.

The wet pick-up vacuum cleaner 12 is a conventional type having the usual cylindrical tank or canister provided with a suction inlet to which is fitted a vacuum pick up hose 19. The hose connects to a wand 21 which terminates at a pick up tool indicated generally at 22. The base 17 of the reservoir is provided with a plurality of spaced sockets 23 in each of which is mounted a swivel caster wheel 24 supporting the reservoir 10.

Figure 2:
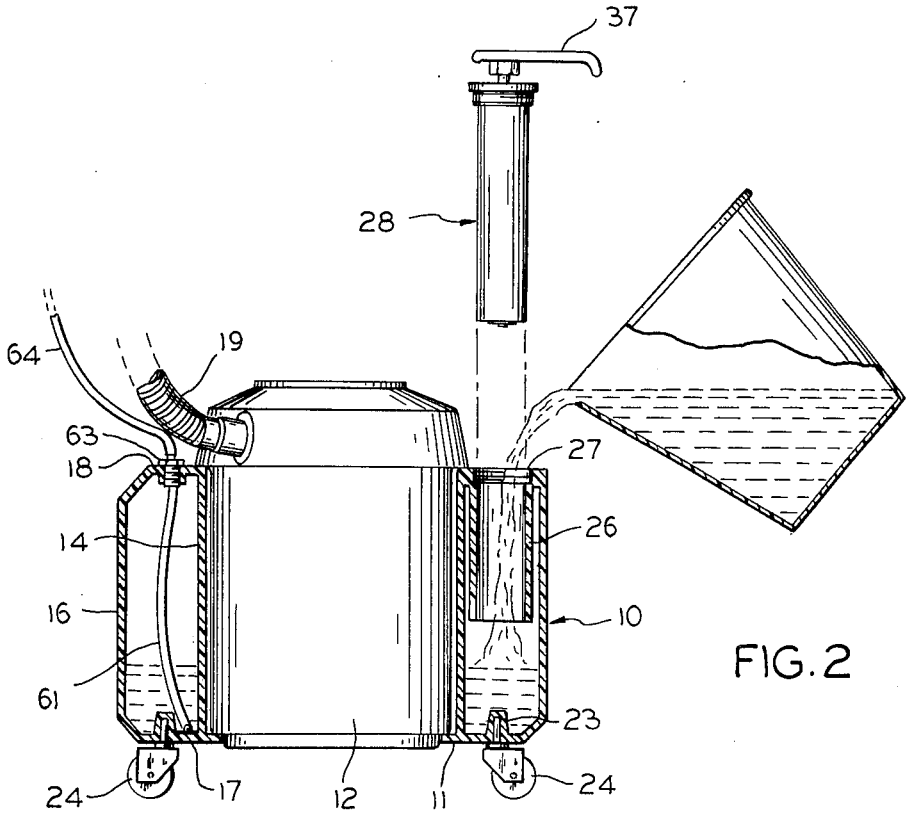
FIG. 2 is an elevational view, partly in cross section, of the apparatus as it would appear with its air pump removed during the process of refilling.

A pipe 26 contained within the reservoir 10 depends from the top wall 18 and communicates with a threaded aperture 27 in said wall. The pipe 26 extends downwardly for approximately half the depth of the reservoir and is arranged to receive an air pump, indicated generally by the numeral 28, and hereinafter to be described in greater detail. As seen in FIG. 2, when the pump 28 is removed the pipe 26 is used as a filler pipe through which liquid detergent may be poured into the reservoir 10. The pipe 26 prevents the reservoir 10 from being filled in excess of half of its capacity.

Figure 3:
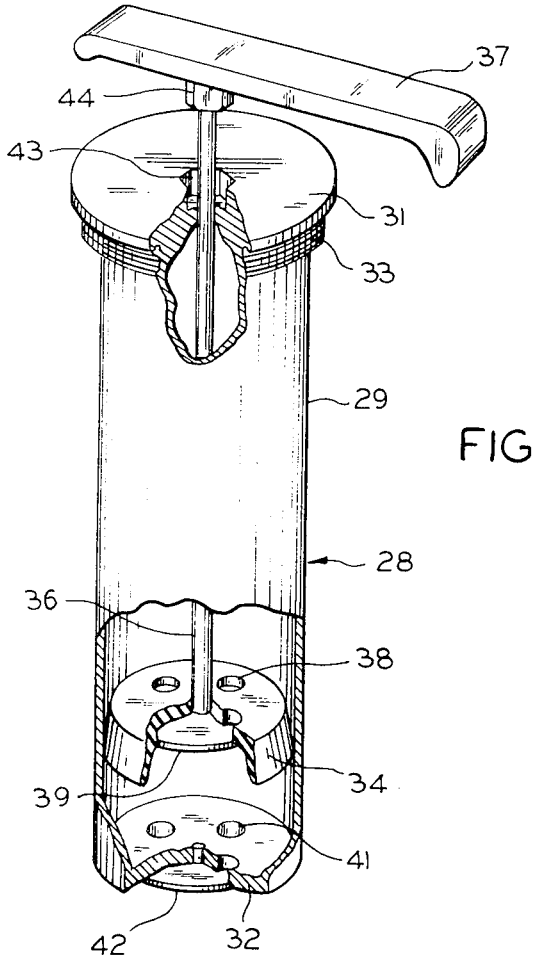
FIG. 3 is a perspective view, on an enlarged scale, with portions broken away, showing the air pump of the apparatus.

Referring to FIG. 3, the air pump 28 comprises a cylindrical body 29 including top and bottom end walls 31 and 32, respectively. The top wall 31 is formed with a threaded boss 33 which engages with the mating threaded opening 27 in the top wall 18. A cup shaped piston 34 is slidably received within the body 29 and is attached to a connecting rod 36 which extends through a loosely fitting hole in the top wall 31. The free end of rod 36 is fastened to a handle 37 which extends laterally of the body 29 and permits an operator to reciprocate the piston 34 axially within the cylinder. The piston 34 includes a plurality of ports 38 and a rubber disc or flapper 39 on the under side of the piston extending over the ports 38. The bottom wall 32 of the cylinder 28 also includes a plurality of ports 41 and a flexible rubber disc or flapper 42 contiguous to the under side of the bottom wall and extending over the ports. The top wall 31 is provided with a central cavity 43, preferably hexagonally shaped, which is adapted to receive a correspondingly shaped boss 44 depending from the handle 37. When the boss 44 is engaged in the cavity 43 the operator may apply a torque action to the handle 37 to effect rotation of the pump 28 to install in or remove the same from the reservoir.

The pump 28 operates in a conventional manner. On the up stroke of the piston 34 ports 41 are caused to be closed by the flapper 42 while the ports 38 are caused to be opened permitting the air from the upper portion of the body 29 to pass through the ports 38 into the space between the piston 34 and the bottom wall 32. On the down stroke the flapper 39 closes the ports 38 and the confined air is forced out of the pump through the ports 41. It will be understood that the space in the body 29 above the piston 34 refills with air on every down stroke, the incoming air passing through the space between the rod 36 and the central aperture in the top wall 31.

Figure 4:
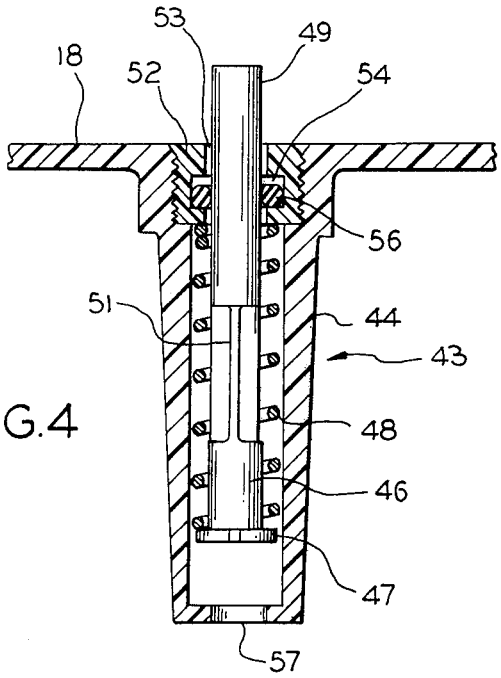
FIG. 4 is a cross sectional view, on an enlarged scale, showing the indicating relief valve of the apparatus.
Figure 5:
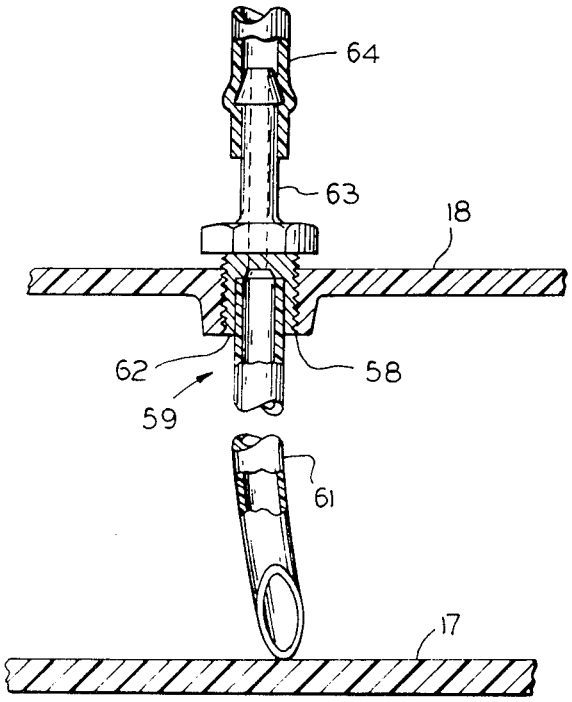
FIG. 5 is a fragmentary cross sectional view, on an enlarged scale, of a detail showing the reservoir outlet and associated connections.
Figure 6:
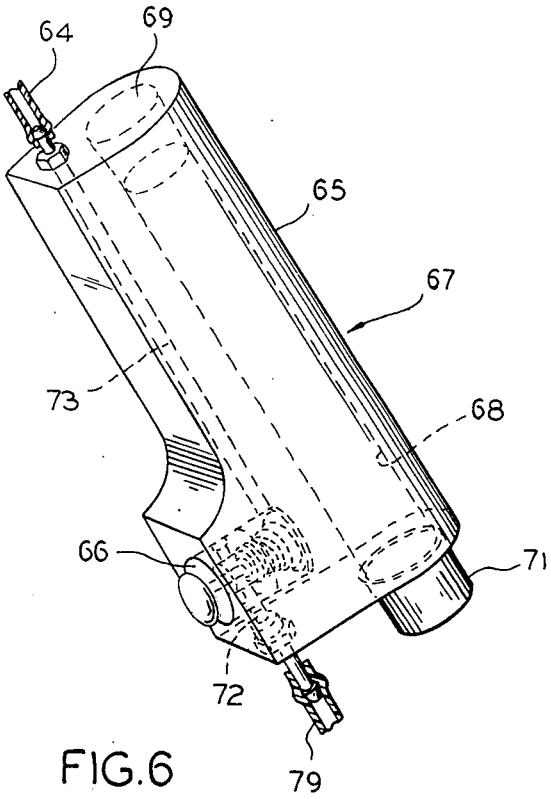
FIG. 6 is a perspective view, in phantom, on an enlarged scale, showing the water flow control valve of the apparatus.

An indicating pressure relief valve 43 as illustrated in detail in FIG. 4 is located in the top wall 18 of the reservoir 10. The valve 43 includes a generally cylindrical body 44 which may be formed as an integral part of the top wall 18, a poppet 46 provided with a flange 47 at its lower end and a spring 48 circumposed about the poppet and normally biasing the poppet 46 in a downward direction. The poppet 46 preferably is formed of low friction plastic such as Teflon or polyethylene and includes an upper cylindrical portion 49, an intermediate section 51, preferably square in cross section, and the flange 47 which also preferably is square in cross-section. The poppet 46 is retained within the cylindrical body 44 by a threaded plug 52 provided with a central hole 53 through which the upper cylindrical portion 49 extends. The hole 53 includes an annular recess 54 in which is received a conventional O-ring 56 formed of appropriate elastomeric material such as Neoprene. While clearance is provided between the hole 53 and the cylindrical portion 49, the O-ring 56 affords an air tight seal between the plug 52 and the cylindrical portion 49 while permitting axial movement of the poppet 46 relative to the body 44. The lower end of the body 44 is provided with an aperture 57 communicating with the reservoir 10. As will be apparent the spring 48 normally biases the poppet 46 to its lowermost position within the body 44. As the pressure of the air within the reservoir 10 rises by reason of the operation of the pump 28 pressurized air passes through aperture 57 and acts on the poppet 46 elevating it against the resistance of the spring 48 so that the cylindrical portion 49 protrudes above the wall 18 by a distance proportional to the pressure acting on the poppet. When the pressure exceeds the normal operating range the non-circular intermediate section 51 of the poppet engages the O-ring 56 affording clearance to permit air to escape. When the pressure within the reservoir 10 is thereby reduced to normal operating range, the cylindrical portion 49 of the poppet moves into engagement with the O-ring 56 thereby sealing off any further escape of air. Accordingly, it will be seen that the valve 43 functions not only to indicate the level of pressure within the reservoir 10 but also to prevent inadvertent overpressurization of the reservoir and the possibility of rupture.

The top wall 18 of the reservoir 10 is provided with an internally threaded outlet 58. An outlet assembly 59 comprising a plastic pick-up tube 61 having sufficient length to extend to the bottom of the reservoir 10 is suitably connected to a bushing 62 threaded into the outlet 58, the bushing having a barbed extension 63 to which is connected a flexible plastic hose 64. The bottom end of the plastic pick-up tube 61 preferably is cut on the bias to provide a maximum opening through which the cleaning solution enters the pick-up tube. The hose 64 is connected to a water control valve 66 which is part of a pick-up flow visualizer assembly 67 mounted on the upper end of the vacuum wand 21. The assembly 67 comprises a body 65 made preferably of a tough transparent plastic, such as Polycarbonate, and includes a cylindrical passage 68, one end portion of which is tapered as at 69 with the opposite end of the cylindrical passage 68 being provided with a tapered tubular extension 71 which is similar to the end fitting of the vacuum pick-up hose 19. The tubular extension 71 is received in the end of the vacuum cleaner wand 21. Thus, the valve 66 and visualizer body 65 may be interposed between the pick-up hose 19 and the wand 21 or it may be removed, at will, so that the hose and wand may be connected together in a conventional manner without the assembly 67. Because the body 65 is transparent the operator may observe the flow of dirty cleaning solution as it is being extracted from a carpet being cleaned.

Figure 7:
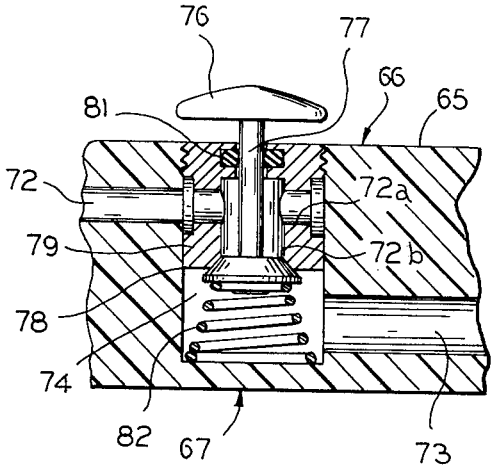
FIG. 7 is a cross-sectional view, on an enlarged scale, of a detail of the valve shown in FIG. 6.

The body 65 includes two longitudinally extending passages 72 and 73, one offset from the other, and both communicating with a cavity 74 (FIG. 7). Received within the cavity 74 is the valve 66 including a pushbutton 76 connected to one end of a cylindrical push rod 77 to the other end of which is secured a frusto-conical poppet 78 which engages a tapered seat of a valve core 79 which is screwed into the cavity 74. The valve core 79 includes an array of cross-drilled parts **72*a* disposed in registration with the inlet passage 72 and communicating said passage with a central bore 72*b* in the core 79. An O-ring 81 is confined in an annular groove in the core and is circumposed about the rod 77 to effect sealing engagement therewith. A compression spring 82 within the cavity 74 normally biases the poppet 78 into engagement with its seat effecting closure of the valve 66. The outlet passage 73 is in communication with the cavity 74 and with a discharge hose 79** through a barbed fitting inserted in the passage 72. The hose 79 is connected to a spray nozzle 83, hereinafter to be described.

Figure 8:
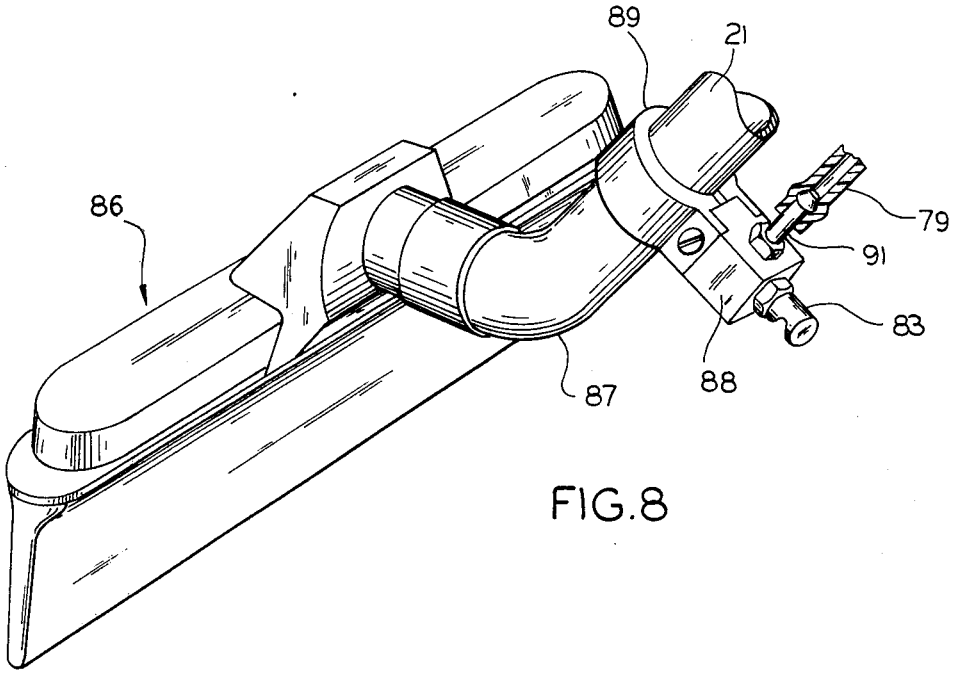
FIG. 8 is a perspective view, on an enlarged scale, of the suction tool of the apparatus showing the installation of the spray nozzle thereon.

A pick-up or suction tool 86, as employed with the apparatus hereinabove described, is shown in greater detail in FIG. 8. The tool 86 is connected to a swivel elbow 87 connected to the lower end of the wand 21. The tool includes a working face having a narrow elongated mouth or orifice 88. Secured as with a clamp 89 to the wand end of the elbow 87 is a block 88 which is drilled and tapped to provide communicating passages. One such passage accepts a barbed fitting 91 connected to the discharge hose 79, while the other receives the spray nozzle 83. It should be apparent that when the reservoir 10 containing washing fluid is pressurized and when the push button 76 of the water control valve is depressed, washing solution will be forced to the spray nozzle 83 and will be sprayed therefrom onto the floor or carpet to be cleaned.

In the use of the apparatus, hereinabove described, the pump 28 is removed in the manner previously noted and a solution of hot tap water and an appropriate detergent is poured into the reservoir 10 filling the reservoir to approximately one-half of its capacity. The pump 28 then is replaced and tightened in position using the pump handle 37 as a torque lever. The reservoir 10 is then pressurized using the air pump 28 to force air into the ullage space above the cleaning solution until the pressure relief valve 43 opens indicating that the proper operating pressure has been reached. The valve 66 is operated to release a spray of washing solution onto a carpet surface to be cleaned. Simultaneously, the operator manually moves the wand 21 about, preferably, back and forth in a limited area, in order to distribute the washing solution over said area. When this area has been thoroughly saturated the flow of washing solution is interrupted and the vacuum cleaner 12 is operated to pick up the dirty washing solution from the floor surface or from the fibers of the carpet being cleaned. The operator may view the flow of air and dirty washing solution through the transparent visualizer assembly 67 and may determine when substantially all of the spent washing solution has been extracted from the area being treated. When no further extraction appears to be taking place the area is considered cleaned and the operator may move on to another area, repeating the procedure. As the washing solution in the reservoir 10 is consumed the air pressure correspondingly decreases and ultimately the operator will notice that the spray nozzle 83 fails to deliver a satisfactory flow. At this point the operator re-pressurizes the reservoir 10 with the air pump 28, as hereinabove described, and this process is repeated until all of the washing solution has been discharged and extracted from the carpeting. When the reservoir 10 is empty the operator removes the vacuum canister 12 and empties it into a convenient drain. The system hereindescribed may then be refilled, re-pressurized and used to continue the process until the entire area is clean.

In a preferred embodiment designed as an accessory for a popular brand of a canister type wet-pick-up vacuum cleaner having a 4-gallon useful liquid pick-up capacity, the reservoir of an apparatus, in accordance with my invention, may have an inside diameter of 12 inches and an outside diameter of 18 inches and a height of approximately 10 inches. This provides the reservoir at half filled capacity with about 3 gallons of liquid. The preferred maximum operating pressure is about 9 psig. Accordingly, the wall thickness of the polypropylene reservoir should be approximately one-eighth inch. The spray nozzle is a common type of flat fan sprayer having an orifice diameter of 3/32 inch. This nozzle produces an acceptable flat spray that pressures down to 6 psi at which point the reservoir must be re-pressurized. The system, as above described, will clean a typical 9 by 12 feet shag carpet with two pressurizations of the reservoir and this process consumes the entire three gallons of washing solution, leaving the reservoir empty and the final pressure somewhat above 6 psig. The spray nozzle is located approximately six inches above the suction pick-up tool and will discharge a fan shaped spray about 12 inches in width. The pick-up tool has an orifice approximately one-eighth inch wide by 10 inches in length. I have found the extraction efficiency to be about 75% on a typical nylon shag carpet, that is, about 2¼ gallons of dirty cleaning solution is extracted for every three gallons dispensed. The residue remaining in the carpet quickly evaporates and the carpet is ready to walk on within three hours after cleaning. The overall performance, convenience and speed of my apparatus has been found to be comparable to that of larger rental type hot water extraction carpet cleaning machines which are many times more costly to manufacture.

Figure 9:
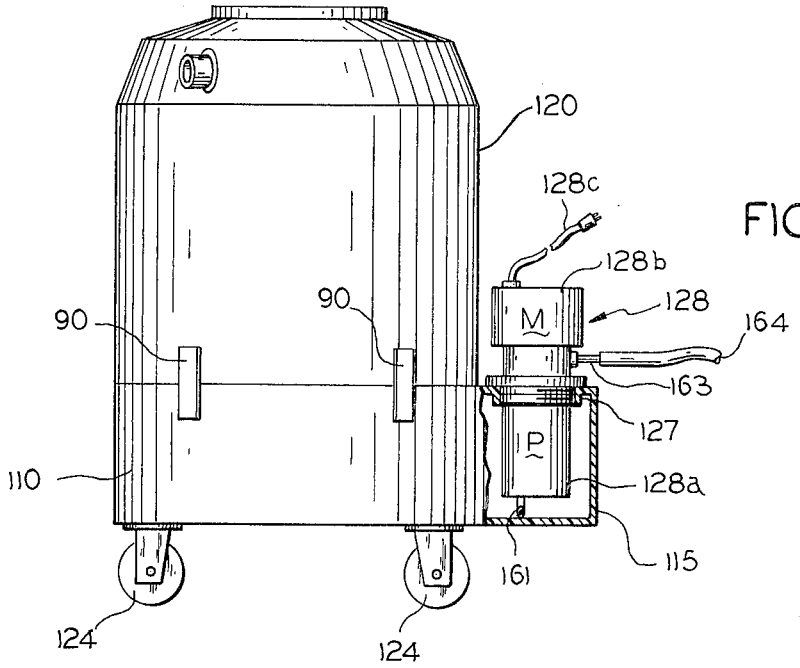
FIG. 9 is an elevational view of a modified embodiment of my invention showing the substitution of a substantially cylindrical reservoir in place of the toroidal reservoir of FIGS. 1 and 2.

In the modified embodiment illustrated in FIG. 9 the reservoir is seen as a generally cylindrical tank 110 having a relatively shallow depth and supported on caster wheels 124. The wet-pick-up vacuum cleaner 120 is supported on the reservoir 110 and secured thereto by a series of releasable fastening elements 90 of a well known conventional construction. The tank 110 is provided with a lateral extension 115 and supported thereon is a combination motor and pump assembly 128 of conventional construction. The assembly 128 is illustrated on an enlarged scale in FIG. 11. In this embodiment the pump 128*a* is coupled to the output of electric motor 128*b* provided with an electric cord 128*c*, the motor being located outside of the tank 110 so that it remains dry, even if not of waterproof construction. The pump 128*a* is provided with an intake tube 161 and a discharge tube 163 adapted for connection to hose 164. The assembly includes an intermediate flange 131 and a threaded portion 133 adapted to be received in engagement with the threaded opening 127 in tank 110. It will be understood that a suitable capped opening, not shown, is provided in tank 110 for filling and emptying the tank. The motor and pump assembly 128 eliminate the need for pressurizing the tank.

Figure 10:
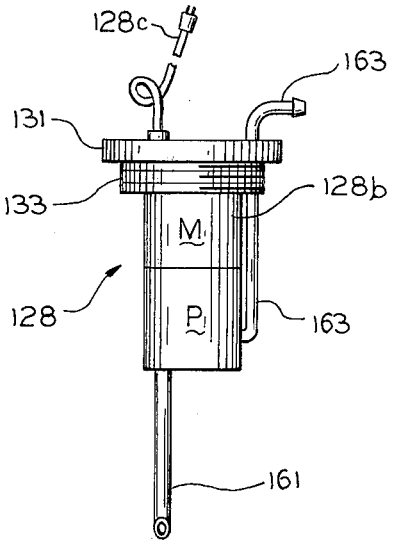
FIGS. 10 and 11 are elevational views, more or less diagrammatic, of modified embodiments of my invention, showing electrically powered motor driven pump assemblies used in place of the air pump shown in FIG. 3.
Figure 11:
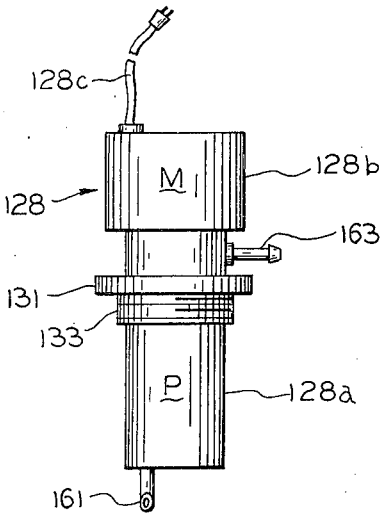

FIG. 10 illustrates a modified motor and pump assembly having the same parts as shown in FIG. 11 but differently arranged. Corresponding parts of the two embodiments are indicated by similar numerals with the numerals of this embodiment being primed. It will be understood that motor 128*b*′ is required to be of waterproof construction since it is disposed within tank 110.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A hot water extraction carpet cleaner for household use, comprising (a) a wet pick-up vacuum cleaner including a recovery tank, a suction tool and a suction conduit connecting said tool to said recovery tank, (b) a toroidal-shaped closed supply tank having a central well and an annular reservoir of substantial depth surrounding said well and adapted to contain the hot cleaning solution, (c) said central well having dimensions slightly larger than the external dimensions of said recovery tank to detachably accommodate the latter therein, (d) a liquid supply tube having one end thereof within the interior of said reservoir below the level of the cleaning solution and the opposite end thereof terminating in proximity to said suction tool, (e) a discharge nozzle connected to said last-mentioned end of said liquid supply tube, (f) means for supplying cleaning solution from said reservoir to said discharge nozzle under pressure, (g) manually operated means for controlling the flow of cleaning solution to said discharge nozzle at desired intermittent periods, and (h) means associated with said suction tool and suction conduit to visibly indicate the mixture of soil and cleaning solution picked up thereby for conveyance to said recovery tank in consequence of the movement of, and application of vacuum to, said suction tool following the application of the cleaning solution to the carpet.

2. An apparatus as set forth in claim 1, wherein said supply tank is provided with an opening in the top thereof, and pumping means insertable through said opening into said tank for feeding the cleaning solution in said reservoir to said discharge nozzle, under pressure.

3. An apparatus as set forth in claim 2, wherein said pumping means is a cylindrical air pump having a cylindrical chamber extending into the upper portion of said reservoir with a piston reciprocable therein connected to an operating handle extending beyond the top of the reservoir, said handle adapted to be reciprocated to create a superatmospheric pressure on the surface of said cleaning solution.

4. An apparatus as set forth in claim 3, including a pressure indicating and relief device mounted at the top of said reservoir.

5. An apparatus as set forth in claim 1, wherein said means for supplying cleaning solution from said reservoir to said discharge nozzle under pressure comprises a motor-operated water pump within said reservoir.

6. An apparatus as set forth in claim 5, wherein the electric motor for operating said water pump is disposed coaxially with said pump and exteriorly of said reservoir.

7. An apparatus as set forth in claim 5, wherein both the electric motor for operating said pump, and the pump coupled directly thereto, are disposed within said reservoir.

* * * * *